US012729671B2

(12) United States Patent
Chou et al.

(10) Patent No.: US 12,729,671 B2
(45) Date of Patent: Sep. 8, 2026

(54) AIR COMPRESSOR STRUCTURE

(71) Applicant: UNIK WORLD INDUSTRIAL CO., LTD., Tainan City (TW)

(72) Inventors: Wen San Chou, Tainan City (TW); Cheng Hsien Chou, Tainan City (TW)

(73) Assignee: UNIK WORLD INDUSTRIAL CO., LTD., Tainan City (TW)

( * ) Notice: Subject to any disclaimer, the term of this patent is extended or adjusted under 35 U.S.C. 154(b) by 7 days.

(21) Appl. No.: 18/777,574

(22) Filed: Jul. 19, 2024

(65) Prior Publication Data

US 2025/0237207 A1 Jul. 24, 2025

Related U.S. Application Data

(60) Provisional application No. 63/624,772, filed on Jan. 24, 2024.

(30) Foreign Application Priority Data

Jul. 5, 2024 (TW) ..... 113125267

(51) Int. Cl.
*F04B 37/12* (2006.01)
*F04B 39/00* (2006.01)
(Continued)

(52) U.S. Cl.
CPC ..... *F04B 37/12* (2013.01); *F04B 39/0016* (2013.01); *F04B 39/122* (2013.01);
(Continued)

(58) Field of Classification Search
CPC .... F04B 37/12; F04B 39/0016; F04B 39/122; F04B 39/123; F04B 39/125; F04B 53/14;
(Continued)

(56) References Cited

U.S. PATENT DOCUMENTS 1,476,794 A * 12/1923 Berry ..... F04B 39/1073
417/571
9,803,633 B2 * 10/2017 Chou ..... F04B 39/10

FOREIGN PATENT DOCUMENTS

GB 190199 A * 12/1922 ..... F04B 53/103
JP 43537 C 9/1922
(Continued)

OTHER PUBLICATIONS

JP58144683 translation (Year: 2025).*
(Continued)

*Primary Examiner* — David N Brandt
(74) *Attorney, Agent, or Firm* — JCIPRNET

(57) ABSTRACT

Disclosed is an air compressor structure, including a cylinder, a piston, a cover, and an anti-return piece. The cylinder has multiple air holes. The piston is reciprocally coupled in the cylinder. The cover is assembled to the cylinder and has a column. Internal spaces of the cylinder and the cover are connected through the air holes. The anti-return piece is movably disposed between the cylinder and the cover. When the piston performs a first stroke, the piston moves close to the air holes to compress air in the cylinder. The compressed air passes through the air holes and lifts the anti-return piece to flow into the cover. When the piston performs a second stroke, a vacuum is formed in the cylinder as soon as the piston moves away from the air holes. The anti-return piece is driven by the vacuum and compressed air to cover and seal the air holes.

6 Claims, 8 Drawing Sheets

(51) Int. Cl.

| | |
|---|---|
| ***F04B 39/10*** | (2006.01) |
| ***F04B 39/12*** | (2006.01) |
| ***F04B 53/00*** | (2006.01) |
| ***F04B 53/10*** | (2006.01) |
| ***F04B 53/12*** | (2006.01) |
| ***F04B 53/14*** | (2006.01) |
| ***F04B 53/16*** | (2006.01) |

(52) U.S. Cl.
CPC ..... *F04B 39/123* (2013.01); *F04B 39/125* (2013.01); *F04B 53/14* (2013.01); *F04B 53/16* (2013.01); *F04B 39/1026* (2013.01); *F04B 39/1086* (2013.01); *F04B 53/007* (2013.01); *F04B 53/103* (2013.01); *F04B 53/1035* (2013.01); *F04B 53/1075* (2013.01); *F04B 53/1085* (2013.01); *F04B 53/123* (2013.01)

(58) Field of Classification Search
CPC .. F04B 53/16; F04B 39/1026; F04B 39/1086; F04B 53/007; F04B 53/103; F04B 53/1035; F04B 53/1075; F04B 53/1085; F04B 53/123
See application file for complete search history.

(56) References Cited

FOREIGN PATENT DOCUMENTS

| | | | | |
|---|---|---|---|---|
| JP | S58111385 U | | 7/1983 | |
| JP | 58144683 | * | 8/1983 | ..... F04B 39/10 |
| JP | 2017129140 | | 7/2017 | |
| JP | 2022163713 | | 10/2022 | |
| KR | 101452487 | | 10/2014 | |
| TW | M536279 | | 2/2017 | |
| TW | M627547 | | 6/2022 | |
| TW | M661012 | | 9/2024 | |

OTHER PUBLICATIONS merriam-webster.com; Abut Definition & Meaning—Merriam-Webster; from merriam-webster.com/dictionary/abut (Year: 2025).*
"Office Action of Japan Counterpart Application", issued on Jul. 31, 2025, p. 1-p. 5.
"Office Action of Taiwan Counterpart Application", issued on Jan. 6, 2025, p. 1-p. 5.
"Office Action of Japan counterpart Application", issued on Dec. 3, 2025, p. 1-p. 6.

* cited by examiner

AIR COMPRESSOR STRUCTURE

CROSS-REFERENCE TO RELATED APPLICATION

This application claims the priority benefit of U.S. provisional application Ser. No. 63/624,772, filed on Jan. 24, 2024 and Taiwan application serial no. 113125267, filed on Jul. 5, 2024. The entirety of each of the above-mentioned patent applications is hereby incorporated by reference herein and made a part of this specification.

BACKGROUND

Technical Field

The disclosure relates to an air compressor structure.

Description of Related Art

The main structure of an air compressor involves a motor driving a piston to perform a reciprocating compression operation in a cylinder. The compressed air can then be filled in connected items to be inflated.

A rubber plug is usually disposed with a spring in the air passage of the air compressor, so that the elastic force of the spring drives the rubber plug to close the passage, or the compressed air drives the rubber plug to overcome the elastic force of the spring and open the passage.

Accordingly, the rubber plug with the spring serves as an anti-return valve. However, in actual operation, due to the limitation of the elastic force of the spring and the hardness of the rubber plug, the passage often cannot be completely closed. In other cases, the passage may not be opened due to the excessive elastic force of the spring. Furthermore, the spring may become fatigued with increased use.

Therefore, how to make improvements corresponding to the above issues has become a topic to ponder for persons skilled in the art.

SUMMARY

The disclosure provides an air compressor structure, having an anti-return functionality for passages through simple combinations of components.

The disclosure provides an air compressor structure, including a cylinder, a piston, a cover, and an anti-return piece. The cylinder has multiple air holes. The piston is reciprocally coupled in the cylinder. The cover is assembled to the cylinder and has a column. Internal spaces of the cylinder and the cover are connected through the air holes. The anti-return piece is movably disposed between the cylinder and the cover. When the piston performs a first stroke, the piston moves close to the air holes to compress air in the cylinder. The compressed air passes through the air holes and lifts the anti-return piece to flow into the cover. When the piston performs a second stroke, a vacuum is formed in the cylinder as soon as the piston moves away from the air holes. The anti-return piece is driven by the vacuum and compressed air to cover and seal the air holes.

Based on the above, in the air compressor structure of the disclosure, the cover is assembled to the cylinder. When the piston compresses the air in the cylinder, the compressed air is transferred to the cover through the air holes of the cylinder. Moreover, the air compressor structure includes the anti-return piece movably disposed between the cover and the cylinder. The anti-return piece can be opened or seal the air holes under the effect of an airflow, enabling the passage of air or achieving an anti-return function along with the reciprocation of the piston in the cylinder.

Further, when the piston performs the first stroke (a forward stroke), the piston compresses the air in the cylinder and transfers the compressed air to the cover through the air holes. At this time, the compressed air also drives the anti-return piece to be lifted relative to the air holes, so that the compressed air flows into the cover successfully. Conversely, when the piston performs the second stroke (a return stroke), the vacuum is formed in the cylinder as soon as the piston moves away from the air holes. Since the compressed air still remains in the cover, the vacuum and the compressed air cause a pressure difference on the anti-return piece, thereby driving the anti-return piece to cover and seal the air holes.

Therefore, the movable anti-return piece moves correspondingly with the motion of the piston and the compressed air or vacuum generated by the piston, further achieving the required anti-return function. Compared to the anti-return valves of the prior art, the anti-return piece of the disclosure undoubtedly meets the requirements with a simpler structure, thereby achieving component simplification and overcoming the issues related to the prior art at the same time.

DESCRIPTION OF THE EMBODIMENTS

Figure 1:
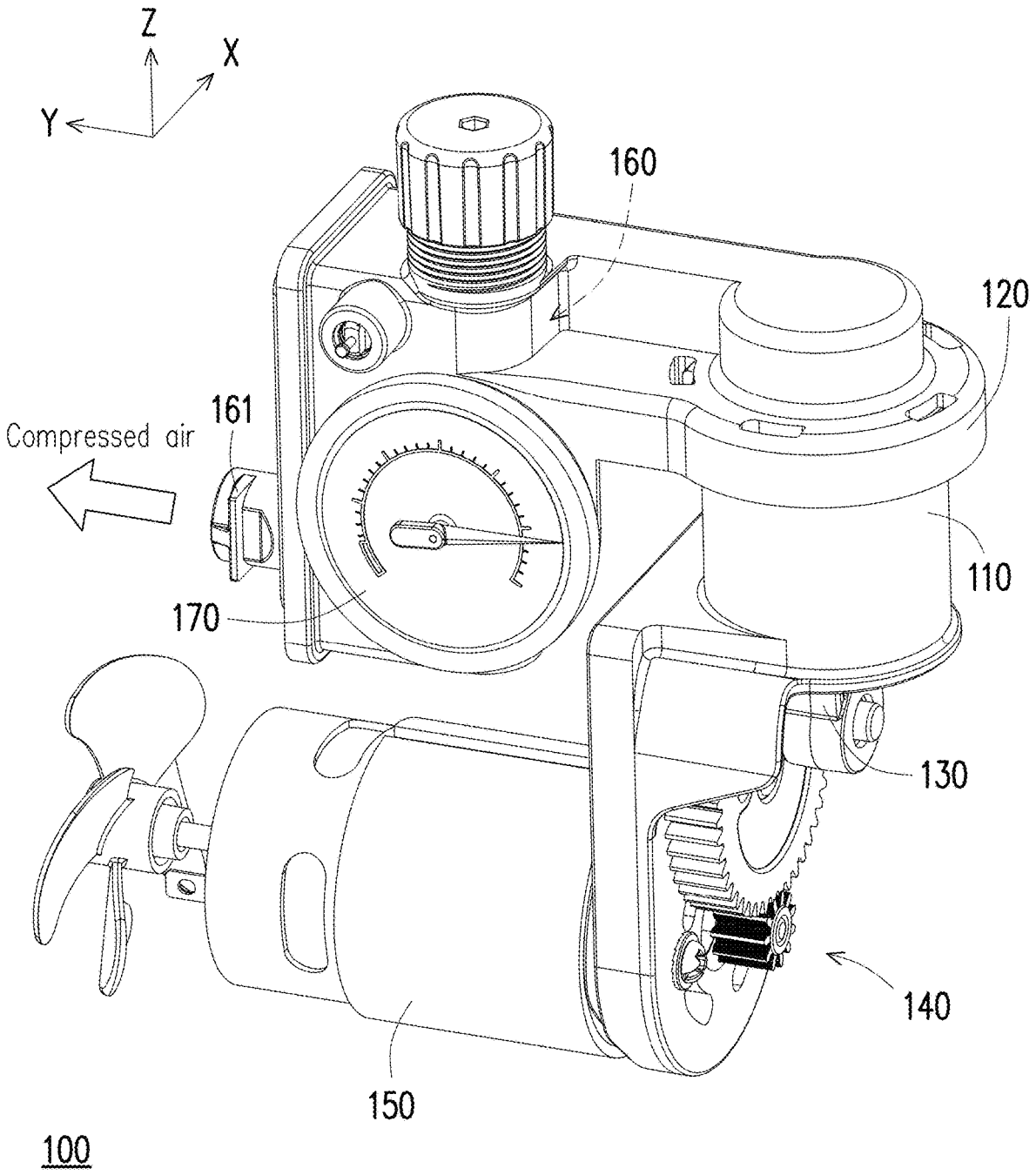
FIG. 1 is a schematic view of an air compressor structure according to an embodiment of the disclosure.
Figure 2:
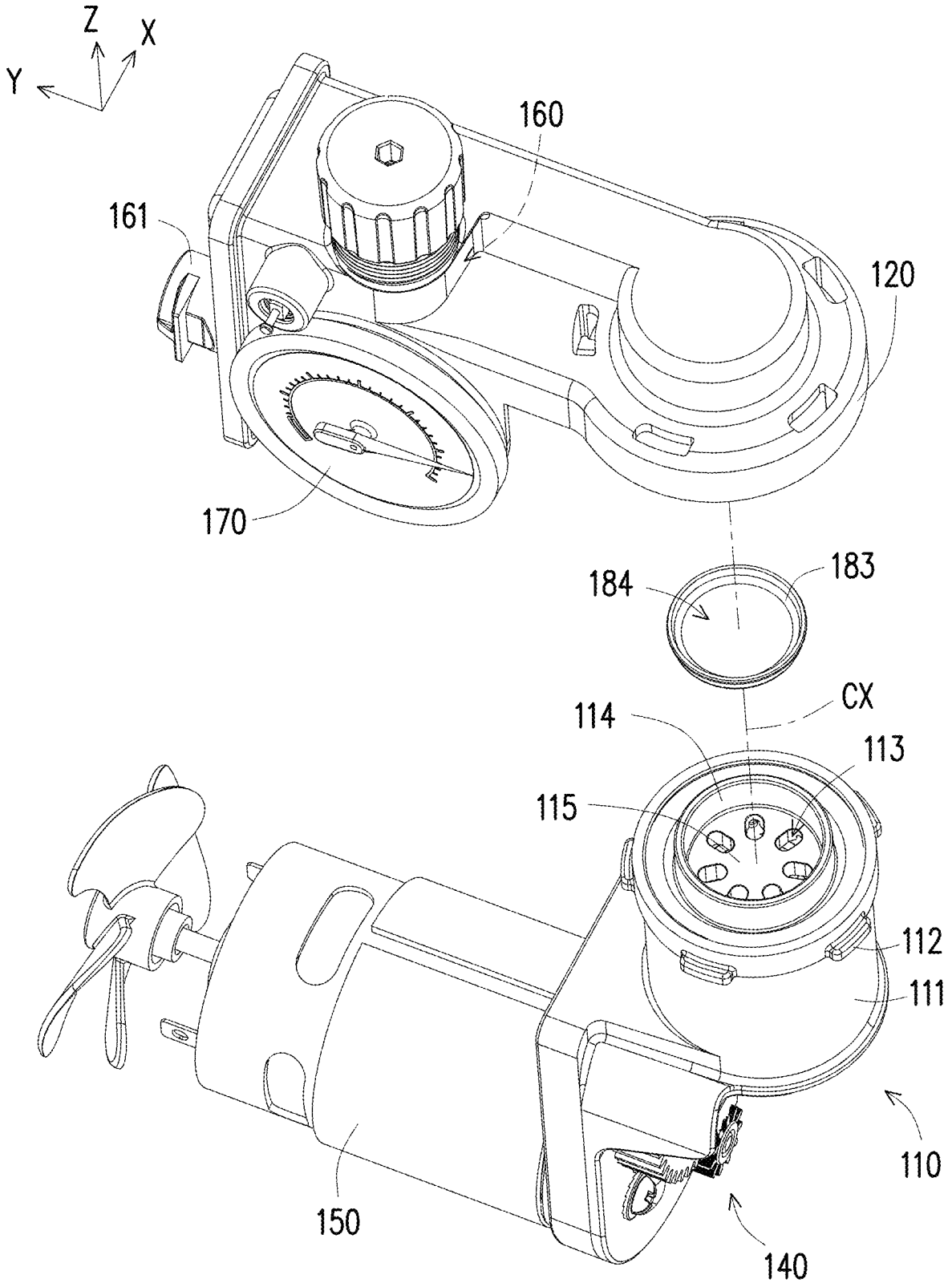
FIGS. 2 and 3 are partial component exploded views of an air compressor structure from different perspectives.
Figure 3:
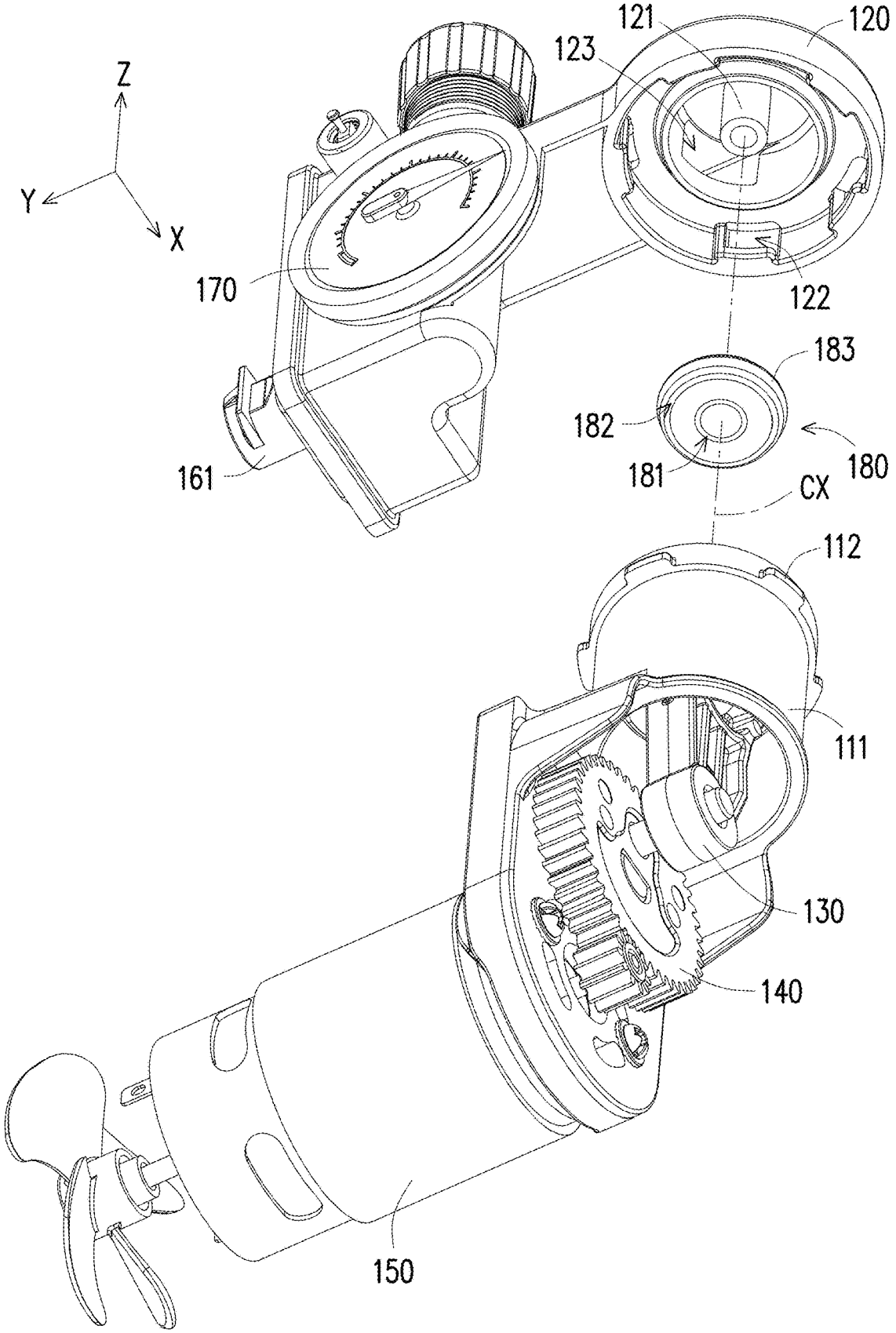

FIG. 1 is a schematic view of an air compressor structure according to an embodiment of the disclosure. FIGS. 2 and 3 are partial component exploded views of an air compressor structure from different perspectives. Here, right-angle coordinates X-Y-Z are provided to facilitate the description of the components. Please refer to FIGS. 1 to 3 at the same time. In this embodiment, an air compressor structure 100 includes a cylinder 110, a piston 130, a cover 120, a transmission mechanism 140, an anti-return piece 180, a motor 150, an air storage base 160, and a pressure gauge 170. The transmission mechanism 140 is connected between a bottom end of the piston 130 and the motor 150. The bottom end of the piston 130 is connected to the transmission mechanism 140, and a top end of the piston 130 is movably coupled in the cylinder 110. As a result, the motor 150, when powered, can drive the piston 130 through the transmission mechanism 140 to reciprocate in the cylinder 110 to compress the air in the cylinder 110. Alternatively, air from an external environment flows into and supplements the cylinder 110 when the piston 130 moves away from the cover 120.

Figure 4:
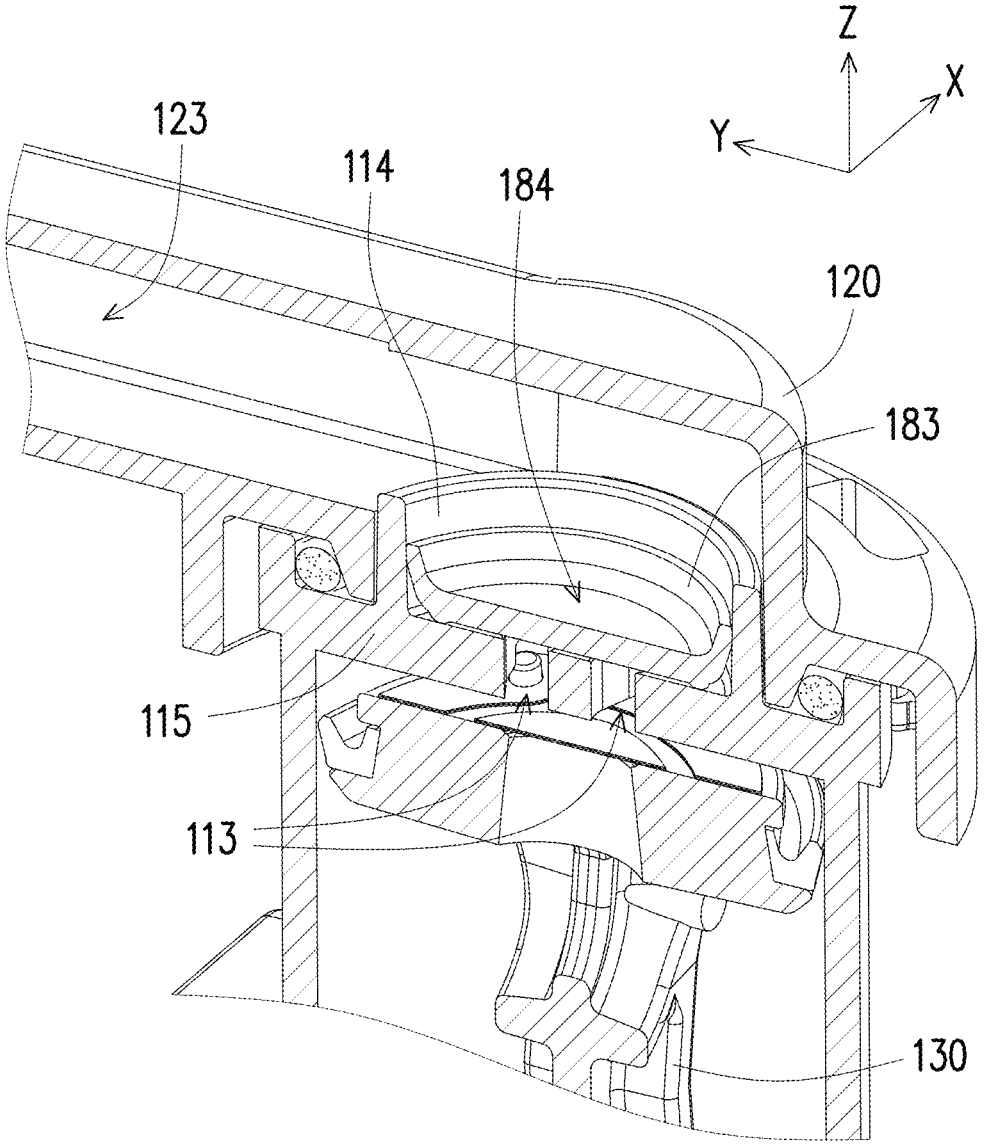
FIG. 4 is a partial cross-sectional view of an air compressor structure from a three-dimensional perspective.

FIG. 4 is a partial cross-sectional view of an air compressor structure from a three-dimensional perspective. Please refer to FIGS. 2 to 4 at the same time. Further, the cylinder 110 includes a cylindrical body 111, multiple protrusion parts 112 disposed annularly on a surface of the body 111, and a partition 115 used to separate an internal space of the cover 120 from an internal space of the cylinder 110. The partition 115 has multiple air holes 113 arranged annularly relative to a central axis CX of the body 111. As shown in FIG. 3, an inner side wall of the cover 120 has multiple slots 122. The cover 120 also has an internal column 121 located at the center and an air storage channel 123 corresponding to the internal space, so that the internal space of the cover 120 can be connected to the air storage base 160 through the air storage channel 123. Therefore, the cover 120 is assembled to the body 111 of the cylinder 110 through the combination of the protrusion parts 112 and the slots 122. Moreover, the internal space of the cover 120 becomes adjacent to the internal space of the cylinder 110 through the partition 115, and the two internal spaces are communicated through the air holes 113.

In addition, as shown in FIG. 1, the air storage base 160 has an air outlet 161 so as to be connected to an item to be inflated, such as a tire (not shown). A pressure gauge 170 is disposed in between, so that a user learns about an air pressure in the air storage base 160. In simple terms, when the piston 130 is driven and performs reciprocating strokes in the cylinder 110, compressed air is continuously generated and transferred sequentially from the internal space of the cylinder 110, the internal space of the cover 120, the air storage channel 123, the air storage base 160, and the air outlet 161 to the item to be inflated so as to inflate the item.

As shown in FIGS. 2 and 3, in this embodiment, the anti-return piece 180 is disposed between the cylinder 110 and the cover 120. The anti-return piece 180 has a bowl-shaped profile, enabling the column 121 of the cover 120 to correspond to an inner bowl bottom 184 of the anti-return piece 180. The anti-return piece 180 also has two annular ribs facing the cylinder 110 and sharing the central axis CX. The two annular ribs are distinguished as an outer annular rib 182 and an inner annular rib 181, respectively abutting the partition 115 of the cylinder 110 to reduce a contact area between the bowl-shaped profile and the partition 115. In simple terms, the anti-return piece 180 in this embodiment has a top surface (the inner bowl bottom 184) and a bottom surface opposite to each other. The top surface is flat so as to receive pressure from the column 121. The annular ribs are located on the bottom surface and supported by the partition 115. Moreover, the cylinder 110 has a limit ring 114 extending from the partition 115. A bowl edge 183 of the bowl-shaped profile abuts an inner annular wall of the limit ring 114.

Figure 5:
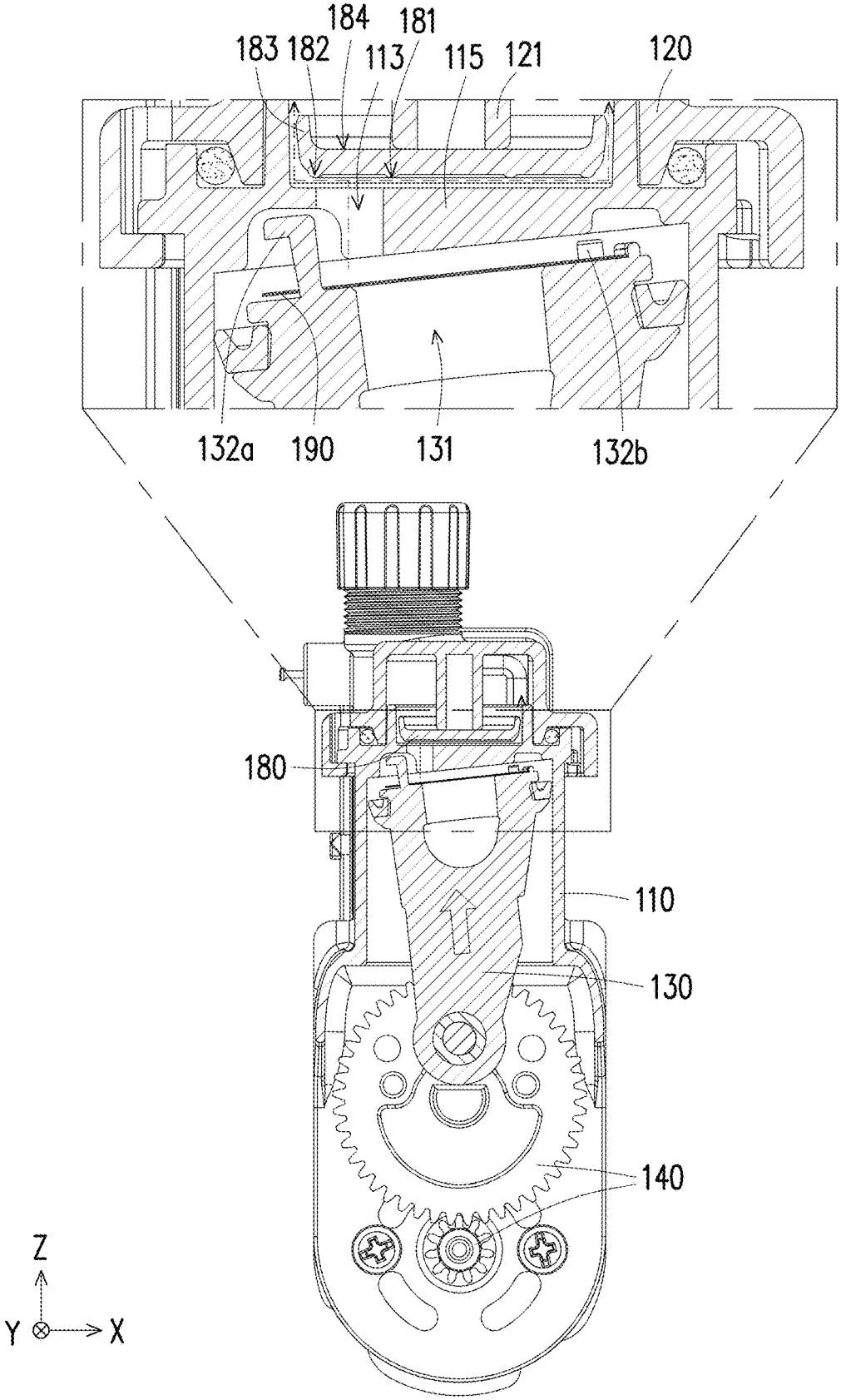
FIGS. 5 and 6 are partial cross-sectional views of an air compressor structure.
Figure 6:
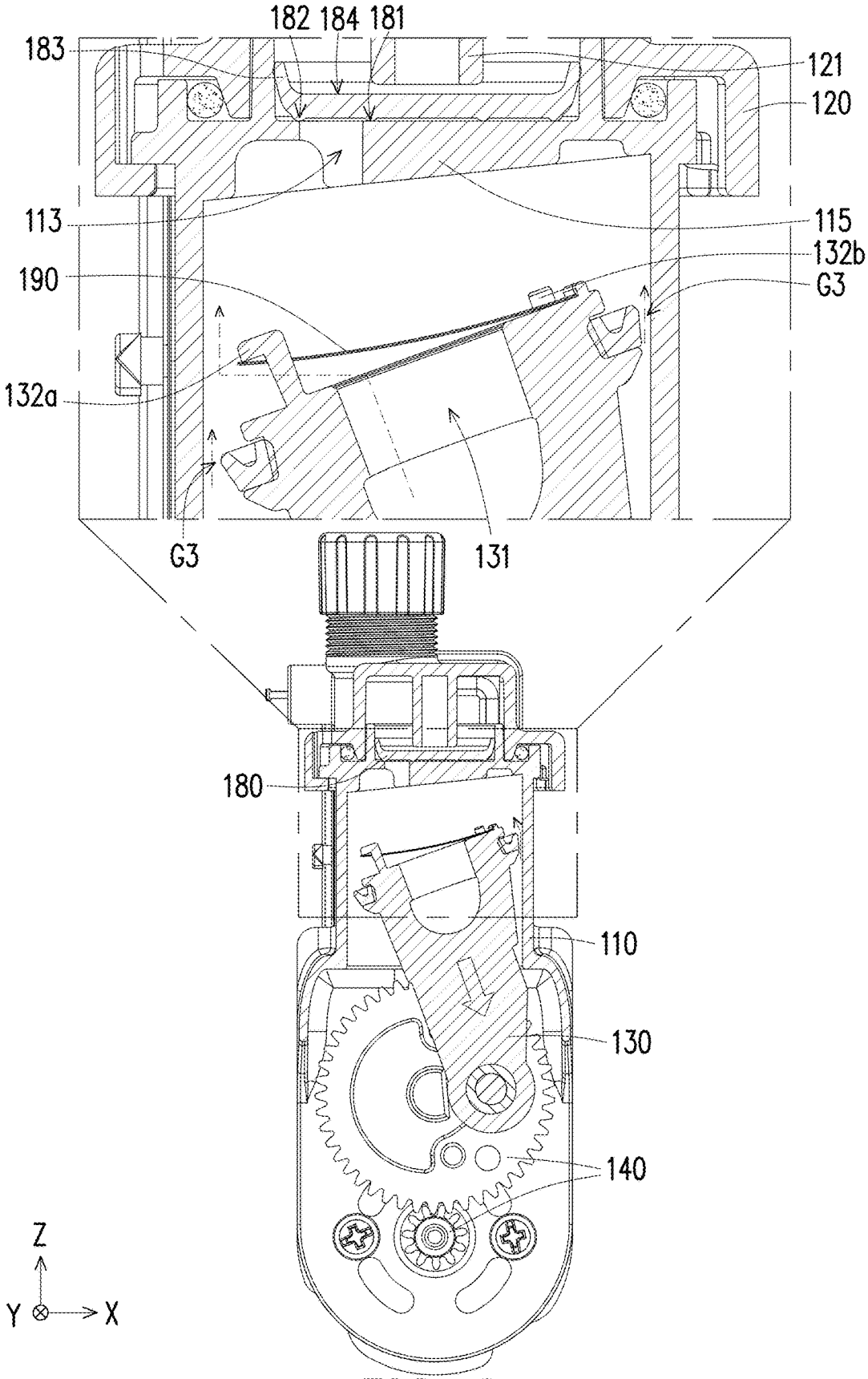

FIGS. 5 and 6 are partial cross-sectional views of an air compressor structure. Please refer to FIGS. 5 and 6 at the same time. In this embodiment, since the anti-return piece 180 covers the air holes 113 of the partition 115, the anti-return piece 180 can move (along the Z axis) between the column 121 and the partition 115 under the effect of an airflow, as described in detail later, wherein airflow paths are shown as dashed arrows.

As shown in FIG. 5, when the piston 130 performs a first stroke (a forward stroke), the top end of the piston 130 moves toward the partition 115 to compress the air originally between the piston 130 and the partition 115 and transfer the compressed air from the internal space of the cylinder 110 into the internal space of the cover 120 through the air holes 113. At this time, the compressed air lifts the anti-return piece 180, so that the inner bowl bottom 184 of the anti-return piece 180 abuts the column 121, and the bowl edge 183, driven by the compressed air, moves away from the inner annular wall of the limit ring 114 (labeled in FIG. 4). Thus, the compressed air flows into the internal space of the cover 120 successfully.

As shown in FIG. 6, when the piston 130 performs a second stroke (a return stroke), a vacuum is formed in the cylinder 110 as soon as the top end of the piston 130 moves away from the air holes 113. At this time, the anti-return piece 180 is driven by the vacuum and the compressed air (in the internal space of the cover 120) and moves in the negative Z-axis direction to abut the partition 115 and cover the air holes 113. The bowl edge 183 abuts the inner annular wall of the limit ring 114 (labeled in FIG. 4). At the same time, a gap G3 is further formed between the top end of the piston 130 moving away from the partition 115 and an inner wall of the cylinder 110, enabling the air from the external environment to enter the cylinder 110 so that the piston 130 can compress the air entering the cylinder 110 when performing the next first stroke.

As shown in FIG. 2, the air holes 113 in this embodiment are arranged annularly relative to the central axis CX, and as shown in FIG. 5 or FIG. 6, a projection of the air holes 113 on the anti-return piece 180 is located between the two annular ribs (the outer annular rib 182 and the inner annular rib 181). This reduces the contact area between a bottom surface of the anti-return piece 180 and the partition 115 through the outer annular rib 182 and the inner annular rib 181 so that the anti-return piece 180 can be successfully lifted by the compressed air passing through the air holes 113. When the piston 130 performs the second stroke, due to the vacuum and the compressed air in the cover 120, the anti-return piece 180 is pushed backward by the compressed air in the cover 120 with the outer annular rib 182 blocking the air holes 113 from the internal space of the cover 120. At the same time, the bowl edge 183 abuts the inner annular wall of the limit ring 114 again, providing the anti-return function (preventing the compressed air in the cover 120 from flowing back into the cylinder 110) that the outer annular rib 182 required.

Please refer to FIGS. 5 and 6 again. In the air compressor structure 100 in this embodiment, the piston 130 has an opening 131 and an intake blocking piece 190. The intake blocking piece 190 covers the opening 131 while being elastically deformable so as to open or close the opening 131. When the piston 130 performs the second stroke, as shown in FIG. 6, the intake blocking piece 190 is lifted by the vacuum, enabling the air from the external environment to enter the cylinder 110 through the opening 131. When the piston 130 performs the first stroke, as shown in FIG. 5, the intake blocking piece 190 is recovered and closes the opening 131. The intake blocking piece 190 is fixed to a top portion of the piston 130 through a fixing member **132*b*. The other side is not fixed and remains free so as to be driven by the airflow and open or close the opening 131 successfully. At the same time, a stop member 132*a* is also disposed at the top portion of the piston 130 to provide the lifted intake blocking piece 190 with a stop function when the piston 130 performs the second stroke, thereby preventing the intake blocking piece 190 from deforming excessively and ensuring that the intake blocking piece 190 is recovered successfully when the piston 130** performs the first stroke.

Figure 7A:
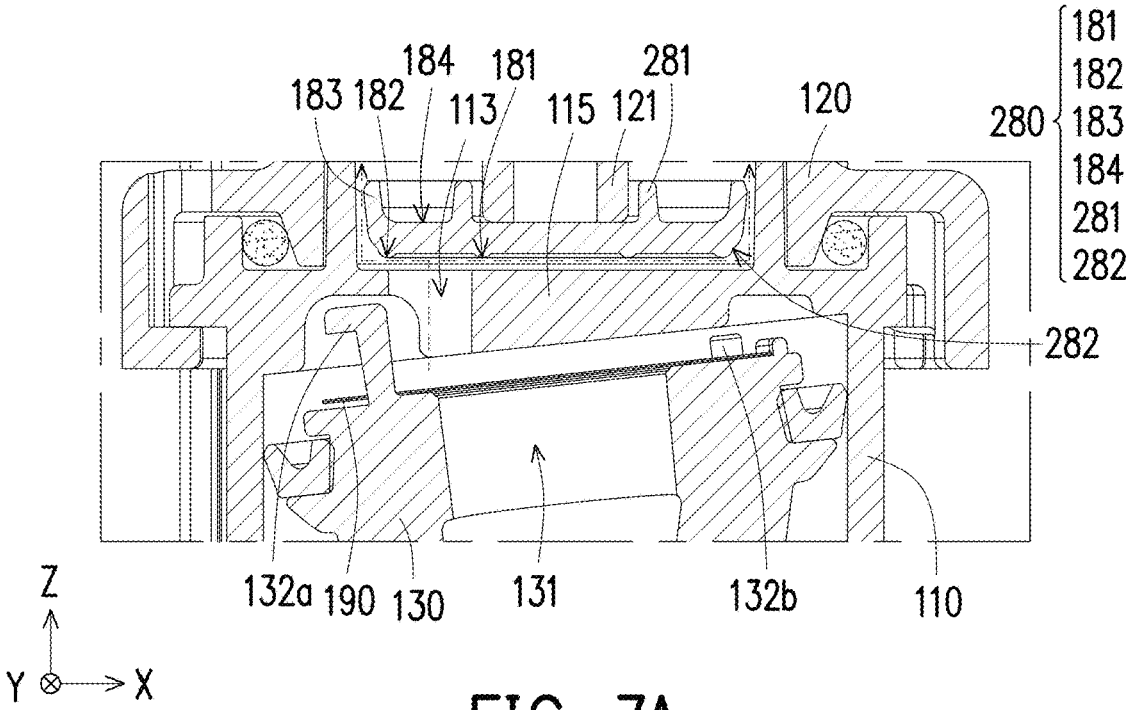
FIGS. 7A and 7B are partial cross-sectional views of an air compressor structure according to another embodiment of the disclosure.
Figure 7B:
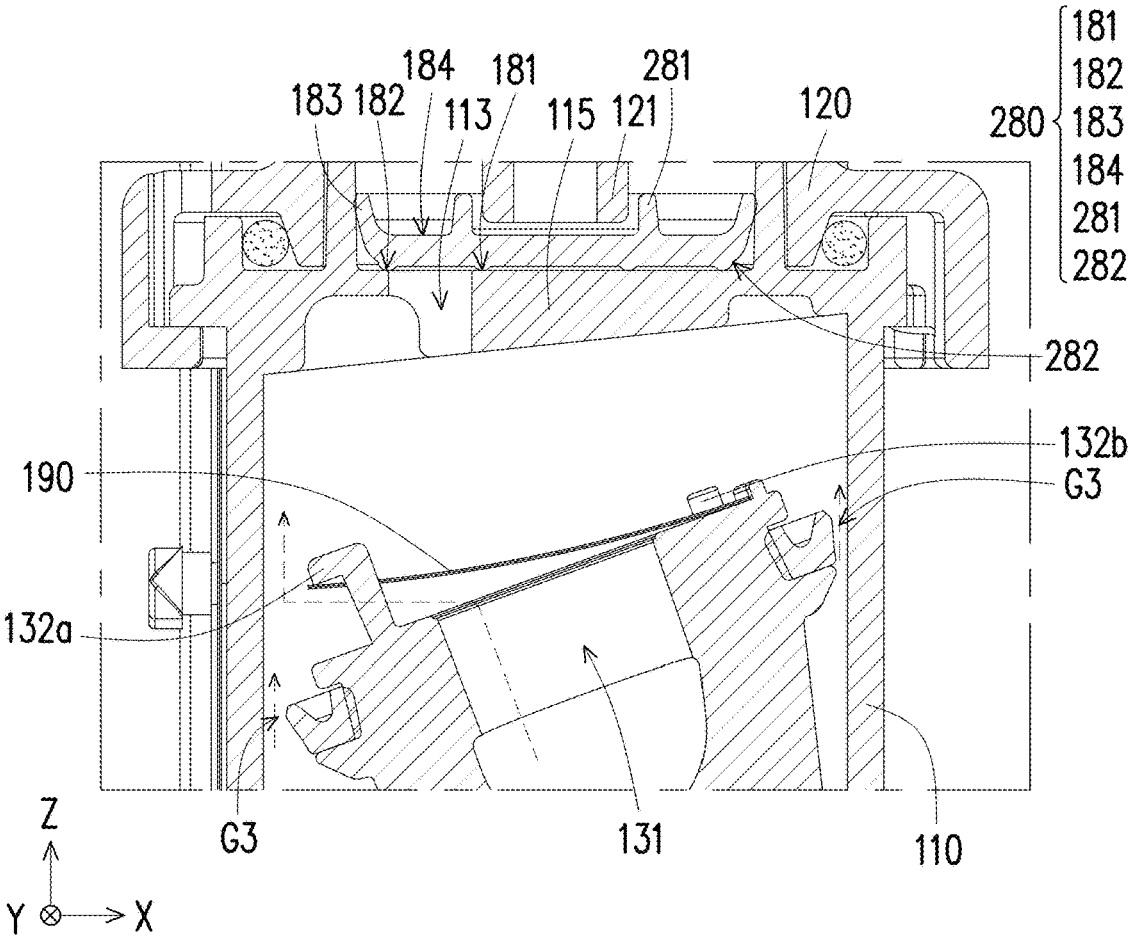

FIGS. 7A and 7B are partial cross-sectional views of an air compressor structure according to another embodiment of the disclosure. Please refer to FIGS. 7A and 7B. The piston 130 is shown in different states, similar to FIGS. 5 and 6. In this embodiment, an anti-return piece 280 includes a limit ring 281, an inner annular rib 181, an outer annular rib 182, a bowl edge 183, and a recess 282. The functions of the inner annular rib 181, the outer annular rib 182, and the bowl edge 183 are as described in the previous embodiment and will not be repeated. The limit ring 281 extends and protrudes from the inner bowl bottom 184 and is movably sleeved on the column 121 correspondingly. Thus, when the anti-return piece 280 moves along the Z-axis just as the anti-return piece 180, the column 121 can maintain a sleeved relationship with the limit ring 281, so that the column 121 provides the anti-return piece 280 with a limiting effect in the X-Y plane.

Figure 8:
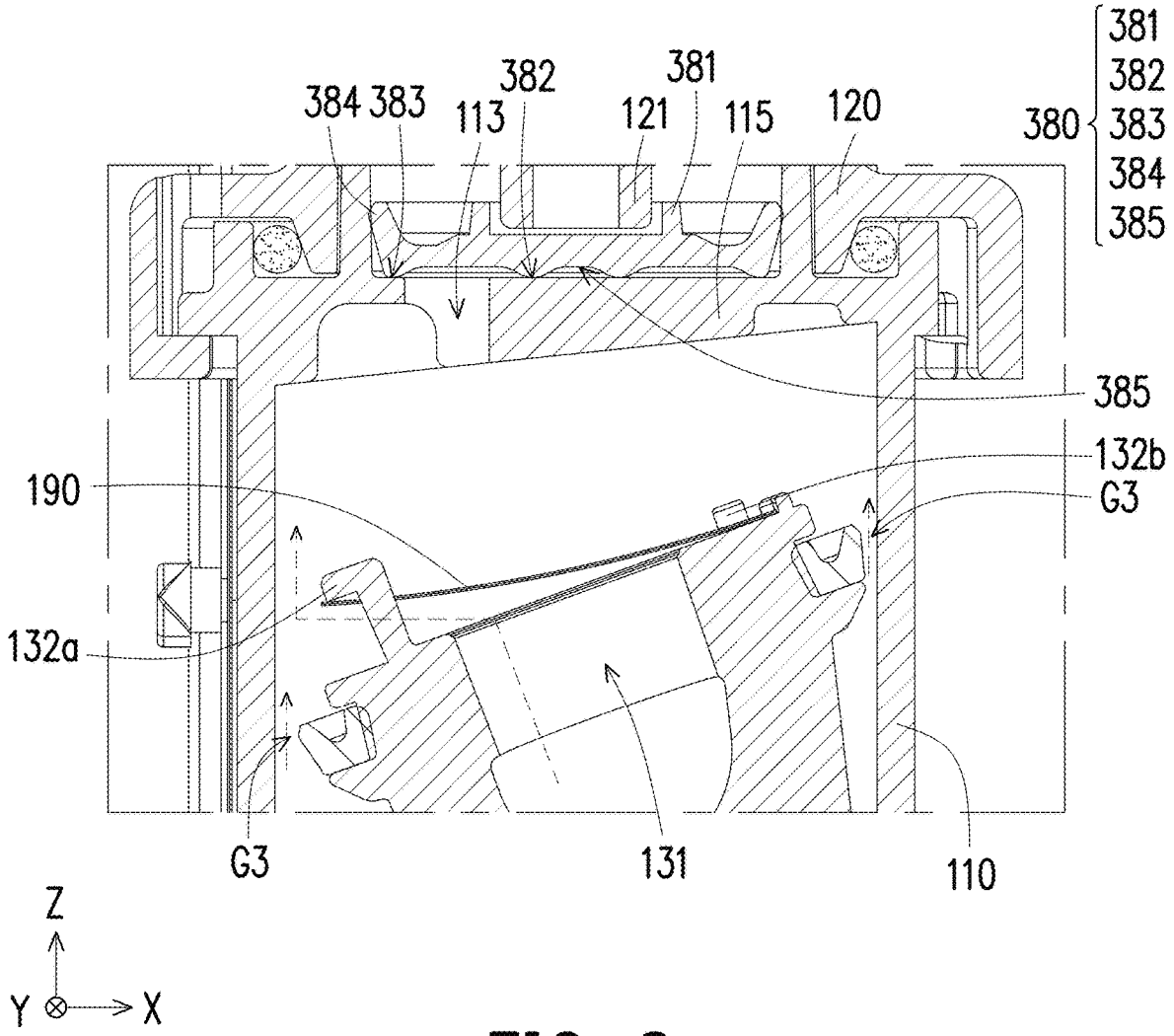
FIG. 8 is a partial cross-sectional view of an air compressor structure according to still another embodiment of the disclosure.

FIG. 8 is a partial cross-sectional view of an air compressor structure according to still another embodiment of the disclosure. Please referring to FIG. 8 in conjunction with FIGS. 7A and 7B. In this embodiment, an anti-return piece 380 includes a limit ring 381, an inner annular rib 382, an outer annular rib 383, and a bowl edge 384. The inner annular rib 382 further forms a recess 385 at the outer bowl bottom. Here, in addition to the limit ring 381, the inner annular rib 382, the outer annular rib 383, and the bowl edge 384 having the same functions as (the limit ring 281, the inner annular rib 181, the outer annular rib 182, and the bowl edge 183 in) the previous embodiment, the structural strength of the anti-return piece 380 is further improved by increasing structural thickness and width as well as profile undulations, thereby improving the durability of the anti-return piece 380. Forming the recess 385 is also a means to reduce a contact area between the anti-return piece 380 and the partition 115 in response to the increase in the structural thickness and width. Thus, the anti-return piece 380 can still be driven by the compressed air successfully. In addition, compared to the previous embodiments where the anti-return piece 280 (same for the anti-return piece 180) forms the recess 282 due to a step difference between the bowl edge 183 and the outer annular rib 182, in this embodiment, the outer annular rib 383 is flush with the bowl edge 384. The purpose is also to effectively improve the structural strength of the anti-return piece 380 under the premise of the anti-return piece 380 successfully performing the functions described in the previous embodiments.

In summary, in the above embodiments of the disclosure, the movable anti-return piece is used in conjunction with the column of the cover for the air compressor structure, so that the anti-return piece can be opened and closed relative to the air holes under the effect of the airflow, enabling the compressed air to pass through when opened and sealing the air holes when closed to achieve the required anti-return function.

Further, when the piston performs the first stroke (a forward stroke), the piston compresses the air in the cylinder and transfers the compressed air to the cover through the air holes. At this time, the compressed air also drives the anti-return piece to be lifted relative to the air holes. Since annular ribs are disposed on the bottom surface of the anti-return piece, the contact area between the anti-return piece and the partition is reduced. Thus, the compressed air successfully lifts the anti-return piece and be transferred to the internal space of the cover. At this time, the anti-return piece moves upward and is stopped by the column of the cover.

Conversely, when the piston performs the second stroke (a return stroke), the vacuum is formed in the cylinder as soon as the piston moves away from the air holes. Since the compressed air still remains in the cover, the compressed air and the vacuum cause a pressure difference on the anti-return piece, thereby driving the anti-return piece to return to a position where the anti-return piece covers and seals the air holes. Through the bowl edge of the anti-return piece abutting the limit ring of the cylinder as well as the annular ribs abutting the partition, the anti-return piece keeps the compressed air in the cover, preventing the compressed air from flowing back into the cylinder. Meanwhile, due to the vacuum, the air from the external environment can flow into the cylinder through the opening of the piston and the gap between the piston and the cylinder wall for the next first stroke of the piston.

Therefore, the movable anti-return piece moves correspondingly with the motion of the piston and the compressed air or vacuum generated by the piston, further achieving the required pass-through of the compressed air or the required anti-return function. Compared to the anti-return valves of the prior art, the anti-return piece of the disclosure obviously achieves component simplification, thereby overcoming the issues related to the anti-return valves of the prior art at the same time.

What is claimed is:

1. An air compressor structure, comprising:
a cylinder, having a plurality of air holes;
a piston, reciprocally coupled in the cylinder;
a cover, assembled to the cylinder, the cover having a column, wherein an internal space of the cylinder and an internal space of the cover are connected through the plurality of air holes; and
an anti-return piece, movably disposed between the cylinder and the cover,
wherein when the piston performs a first stroke, the piston moves close to the plurality of air holes to compress air in the cylinder, the compressed air passing through the plurality of air holes and lifting the anti-return piece to flow into the cover, and
wherein when the piston performs a second stroke, a vacuum is formed in the cylinder as soon as the piston moves away from the plurality of air holes, and the anti-return piece is driven by the vacuum and the compressed air in the cover to cover and seal the plurality of air holes,
wherein the anti-return piece has a bowl-shaped profile, and the cylinder further has a partition and a limit ring extending from the partition, wherein a bowl edge of the bowl-shaped profile abuts an inner annular wall of the limit ring during the second stroke, the column is adapted to abut an inner bowl bottom of the bowl-shaped profile during the first stroke, and the partition has the plurality of air holes,
wherein the anti-return piece has at least one annular rib located at an outer bowl bottom of the bowl-shaped profile, the at least one annular rib forming a recess on the outer bowl bottom with the bowl edge due to a step difference in between the at least one annular rib and the bowl edge,
wherein the recess faces away from the column and faces toward a junction of the limit ring and the partition.

2. The air compressor structure according to claim 1, wherein the at least one annular rib comprises two annular ribs facing the cylinder, sharing a central axis, and abutting a partition of the cylinder during the second stroke, the partition having the plurality of air holes.

3. The air compressor structure according to claim 2, wherein the plurality of air holes are arranged annularly, and a projection of the plurality of air holes on the anti-return piece is located between the two annular ribs.

4. The air compressor structure according to claim 2, wherein the anti-return piece has a top surface and a bottom surface opposite to the top surface, the two annular ribs being located on the bottom surface, the column being adapted to abut the top surface during the first stroke.

5. The air compressor structure according to claim 1, wherein the anti-return piece has a limit ring, movably sleeved on the column such that the column limits the anti-return piece.

6. The air compressor structure according to claim 1, wherein the piston has an opening and an intake blocking piece, the intake blocking piece covering the opening while being elastically deformable to open or close the opening, wherein when the piston performs the second stroke, the intake blocking piece is lifted by air from an external environment due to the vacuum, enabling the air from the external environment to enter the cylinder through the opening, wherein when the piston performs the first stroke, the intake blocking piece is recovered and closes the opening.

* * * * *